US008702131B1

(12) United States Patent
Gianoli et al.

(10) Patent No.: US 8,702,131 B1
(45) Date of Patent: Apr. 22, 2014

(54) ADJUSTABLE BACKSET MORTISE LOCK

(75) Inventors: Michael Joseph Gianoli, Rice Lake, WI (US); Jason Louis Quinn, Rice Lake, WI (US); Larry Dean Lindloff, Rice Lake, WI (US)

(73) Assignee: Hampton Products International Corporation, Foothill Ranch, CA (US)

( * ) Notice: Subject to any disclaimer, the term of this patent is extended or adjusted under 35 U.S.C. 154(b) by 961 days.

(21) Appl. No.: 12/661,915

(22) Filed: Mar. 26, 2010

(51) Int. Cl.
*E05C 1/00* (2006.01)
*E05C 1/12* (2006.01)

(52) U.S. Cl.
USPC ..... 292/1.5; 292/169; 292/DIG. 60

(58) Field of Classification Search
USPC ..... 292/1.5, 262, 289, 337, 163, 164, 165, 292/169, 169.15, DIG. 60, DIG. 64, DIG. 54, 292/32, 33, 40, 34, 173, 140, 143, 348, 137
See application file for complete search history.

(56) References Cited

U.S. PATENT DOCUMENTS

| | | | | | |
|---|---|---|---|---|---|
| 27,161 | A * | 2/1860 | Raymon | 147/27 |
| 1,586,223 | A * | 5/1926 | Sheinman | 70/128 |
| 2,822,202 | A * | 2/1958 | Welch | 292/1.5 |
| 2,937,897 | A * | 5/1960 | Soderberg | 292/1.5 |
| 3,011,817 | A * | 12/1961 | Eads | 292/140 |
| 3,651,673 | A * | 3/1972 | Sendrowski et al. | 70/450 |
| 4,593,543 | A * | 6/1986 | Stefanek | 70/134 |
| 5,123,684 | A * | 6/1992 | Yeh | 292/244 |
| 6,688,063 | B1 * | 2/2004 | Lee et al. | 52/455 |
| 8,397,548 | B1 * | 3/2013 | Lin | 70/462 |
| 2004/0155477 | A1 * | 8/2004 | Lanigan et al. | 296/50 |
| 2008/0246288 | A1 * | 10/2008 | Hodgin et al. | 292/244 |

* cited by examiner

*Primary Examiner* — Carlos Lugo
*Assistant Examiner* — Faria Ahmad
(74) *Attorney, Agent, or Firm* — Klein, O'Neill & Singh, LLP

(57) ABSTRACT

The mortise lock of the invention has an adjustable backset employing a latch bolt spacer, a dead bolt extender and two body spacers between the mortise lock body and mortise lock face plate. All the spacers are removable.

14 Claims, 5 Drawing Sheets

ADJUSTABLE BACKSET MORTISE LOCK

FIELD OF THE INVENTION

The present invention is directed to an adjustable backset mortise lock that can be manufactured for one backset and readily converted for use for another backset.

BACKGROUND OF THE INVENTION

Mortise locks are commonly used in doors, screen doors, and storm doors. A major portion of a mortise lock is hidden in the cross-section of the door and is normally only accessible through the side of a door. Because of their slim profile, a mortise lock can be easily fit into slim doors, such as doors thinner than 1½ inches. A door locked with a mortise lock normally is a secure door because the lock mechanism is buried within the door. The lock operating mechanism of a mortise lock is only accessible when the door is unlatched and open giving access to the side of the door.

Mortise locks are manufactured by different manufacturers with different backsets—The distance from the face plate to center of the door handle. For example, screen doors come with mortise locks with 1 inch and ¾ inch backset. Replacement mortise locks must have the correct backset. To the best of the inventors' knowledge there are no mortise locks with adjustable backsets. If a mortise lock for a door is to be replaced with a new mortise lock, the new mortise lock must have the correct dimensions and backset. It is impossible to jerry rig a mortise lock with one backset in a door with an existing mortise for another backset.

The present invention is directed to a mortise lock that is manufactured for the minimum backset and yet can be easily modified during the manufacturing process or during the installation step to provide mortise locks with larger backsets. Thus the manufacturer only has to manufacturer one mortise lock with the smallest backset and yet retains the ability to assemble two or more mortise locks with two or more different backsets. This is a plus for consumers because often the manufacturer of mortise locks will only provide mortise locks for one backset due to the expense of manufacturing and warehousing two or more mortise locks with different backsets.

SUMMARY OF THE INVENTION

The present invention is directed to an adjustable backset mortise lock comprising a housing having a front side, the housing containing the lock operating mechanism and adapted to be received in a mortise in the side of a door, the housing having an upper receiver and a lower receiver on its front side, the upper receiver optionally receiving a small spacer for increasing the depth of the housing a predetermined distance, the lower receiver optionally receiving a boss of a face plate spacer for increasing the depth of the housing a predetermined distance; a latch bolt having a front end and an opposing back end and biased to normally extend from the front of the housing, the latch bolt supported by a guide riding in a guide bore in the housing for retraction into and extension out of the housing, the guide having a threaded front end and opposing back end, the threaded front end of the guide threadingly engaging a threaded boss extending out of the back end of the latch bolt, the distance between the front of the latch bolt and the back end of the guide adjustable to increase the reach of the latch bolt when the depth of the housing is increased; a dead bolt with a front side that can be extended out of the front end of the housing or withdrawn into the housing, the dead bolt optionally receiving an extender having a front side to increase the reach of the front end of the dead bolt when the depth of the housing is increased, the extender secured to the front side of the dead bolt; a latch bolt driver cam for retracting the latch bolt into the housing; and a dead bold latch cam for extending and retracting the dead bolt in or out of the housing, the latch bolt drive and the dead bolt drive operated by the lock operating mechanism; and a face plate having openings for the latch bolt and the dead bolt to extend through the face plate detachably fastened to the front of the housing and adapted to be mounted on the side of the door to support the adjustable backset mortise lock in the side of a door, the front side of the housing adopted to receive the face plate spacer to increase the depth of the housing by the predetermined distance, the back side of the face plate received by the front side of the housing or optionally received by the small spacer, the face plate spacer, and the lower receiver when the depth of the housing is increased.

Preferably the upper receiver has a threaded bore to receive a threaded fastener to secure the face plate to the housing.

Preferably the upper receiver has upper and lower parallel walls and a side wall, and the small spacer has a shoulder extending three quarters around the spacer, the shoulder of the small spacer received on the walls of the upper receiver when the small spacer is received within the upper receiver, the small spacer having a bore there through which the threaded fastener extends when securing the face plate to the housing. Preferably the bore in the small spacer is co-axial with the threaded bore in the upper receiver.

Preferably the lower receiver has a threaded bore to receive a threaded fastener to secure the face plate to the housing.

Preferably the lower receiver has upper and side walls, and the boss on the face plate spacer received within the two walls of the lower receiver when the depth of the housing is increased, the face plate spacer having a bore extending through the boss and the face plate, the threaded fastener extending through said bore when securing the face plate to the housing. Preferably the bore of the face plate spacer is co-axial with the threaded bore in the lower receiver.

Preferably the dead bolt of the adjustable backset mortise lock has two countersunk threaded bores receiving flat head threaded fasteners flush with the front side of the dead bolt and the extender has a height and breath substantially equivalent to the height and breadth of the dead bolt.

Preferably the front side of the dead bolt has two threaded bores and the extender has two countersunk smooth bores co-axial with said two threaded bores in the dead bolt, the extender secured to the dead bolt with the flat head threaded fasteners flush with the front side of the extender.

Preferably the housing of the adjustable backset mortise lock has a biasing means to bias the latch bolt with the threaded front end of the guide extending through the biasing means.

Preferably the latch bolt has channels on its top side and bottom side extending from the back side to the front side of the latch bolt, the latch bolt spacer having a finger at the upper portion and a finger at the lower portion of its front face, the latch bolt spacer received on the threaded boss of the latch bolt with the fingers engaging the channels.

A preferred embodiment of the adjustable backset mortise lock of the present invention comprises a housing having a front side, the housing containing the lock operating mechanism and adapted to be received in a mortise in the side of a door, the housing having an upper receiver and a lower receiver on its front side, the upper receiver optionally receiving a small spacer for increasing the depth of the housing a predetermined distance, the lower receiver optionally receiving a boss of a face plate spacer, the upper receiver having a threaded bore to receive a threaded fastener to secure the face plate to the housing, the upper receiver having an upper and lower parallel walls and a side wall, and the small spacer has a shoulder extending three quarters around the spacer, the shoulder of the small spacer receiving the walls of the upper receiver when the small spacer is received within the upper receiver, the small spacer having a bore there through which the threaded fastener extends when securing the face plate to the housing, the lower receiver having a threaded bore to receive a threaded fastener to secure the face plate to the housing, the lower receiver having upper and side walls, and the boss on the face plate received within the two walls of the lower receiver when the depth of the housing is increased, the face plate spacer having a bore extending through the boss and the face plate, the second threaded fastener extending through said bore when securing the face plate to the housing; a latch bolt having a front end and an opposing back end and biased to normally extend from the front of the housing, the latch bolt supported by a guide in the housing for retraction into and extension out of the housing, the guide having a threaded front end and opposing back end, the threaded front end of the guide threadingly engaging a threaded boss on the back end of the latch bolt, the distance between the front of the latch bolt and the back end of the guide adjustable to increase the throw of the latch bolt when the depth of the housing is increased; the latch bolt having channels on its top side and bottom side extending from the back side to the front side of the latch bolt, the latch bolt spacer having a finger at the upper portion and a finger at the lower portion of its front face, the latch bolt spacer received on the threaded boss with the fingers engaging the channels; a biasing means to bias the latch bolt, the threaded front end of the guide extending through the biasing means; a dead bolt with a front side, the dead bolt optionally receiving an extender having a front side to increase the throw of the dead bolt when the depth of the housing is increased, the extender removable secured to the front side of the dead bolt the dead bolt has two counter sunk threaded bores receiving flat head threaded fasteners flush with the front side of the dead bolt and the extender has a height and breath substantially equivalent to the height and breadth of the dead bolt, the front side of the dead bolt has two threaded bores and the extender has two countersunk smooth bores co-axial with said two threaded bores in the dead bolt, the extender secured to the dead bolt with the flat head threaded fasteners flush with the front side of the extender; a latch bolt driver cam for retracting the latch bolt into the housing; and a dead bold latch cam for extending and retracting the dead bolt in or out of the housing, the latch bolt drive and the dead bolt drive operated by the lock operating mechanism; and a face plate having openings for the latch bolt and the dead bolt to extend through, the face plate detachably fastened to the front of the frame and adapted to be mounted on the side of the door to support the adjustable backset mortise lock in the side of a door, the front side of the housing adopted to receive the face plate spacer to increase the depth of the housing by the predetermined distance, the back side of the face plate received by the front side of the housing or optionally received by the small spacer, the face plate spacer, and the lower receiver when the depth of the housing is increased.

Another preferred embodiment of the adjustable backset mortise lock of the present invention comprises a housing having a front side, the housing containing the lock operating mechanism and adapted to be received in a mortise in the side of a door, the housing having an upper receiver and a lower receiver on its front side, the upper receiver receiving a removable small spacer for increasing the depth of the housing a predetermined distance, the lower receiver receiving a boss of a face plate spacer; a latch bolt having a front end and an opposing back end and biased to normally extend from the front of the housing, the latch bolt supported by a guide riding in a guide bore in the housing for retraction into and extension out of the housing, the guide having a threaded front end and opposing back end, the threaded front end of the guide threadingly engaging a threaded boss extending out of the back end of the latch bolt, the distance between the front of the latch bolt and the back end of the guide adjustable to adjust the reach of the latch bolt to accommodate the depth of the housing; a dead bolt with a front side, the dead bolt receiving an extender to increase the reach of the dead bolt when the depth of the housing is increased, the extender removable secured to the front side of the dead bolt (optional element); a latch bolt driver cam for retracting the latch bolt into the housing; and a dead bold latch cam for extending and retracting the dead bolt in or out of the housing, the latch bolt driver cam and the dead bolt driver cam operated by the lock operating mechanism; and A face plate having openings for the latch bolt and the dead bolt to extend through, the face plate detachably fastened to the front of the housing and spaced apart there from by the small spacer and the face plate spacer, the face plate adapted to be mounted on the side of the door to support the adjustable backset mortise lock in the side of a door, the face plate spacer removably secured on the front side of the housing to increase the depth of the housing by the predetermined distance, the back side of the face plate received by the small spacer, the face plate spacer, and the lower receiver when the depth of the housing is increased.

DESCRIPTION OF THE INVENTION

Figure 1:
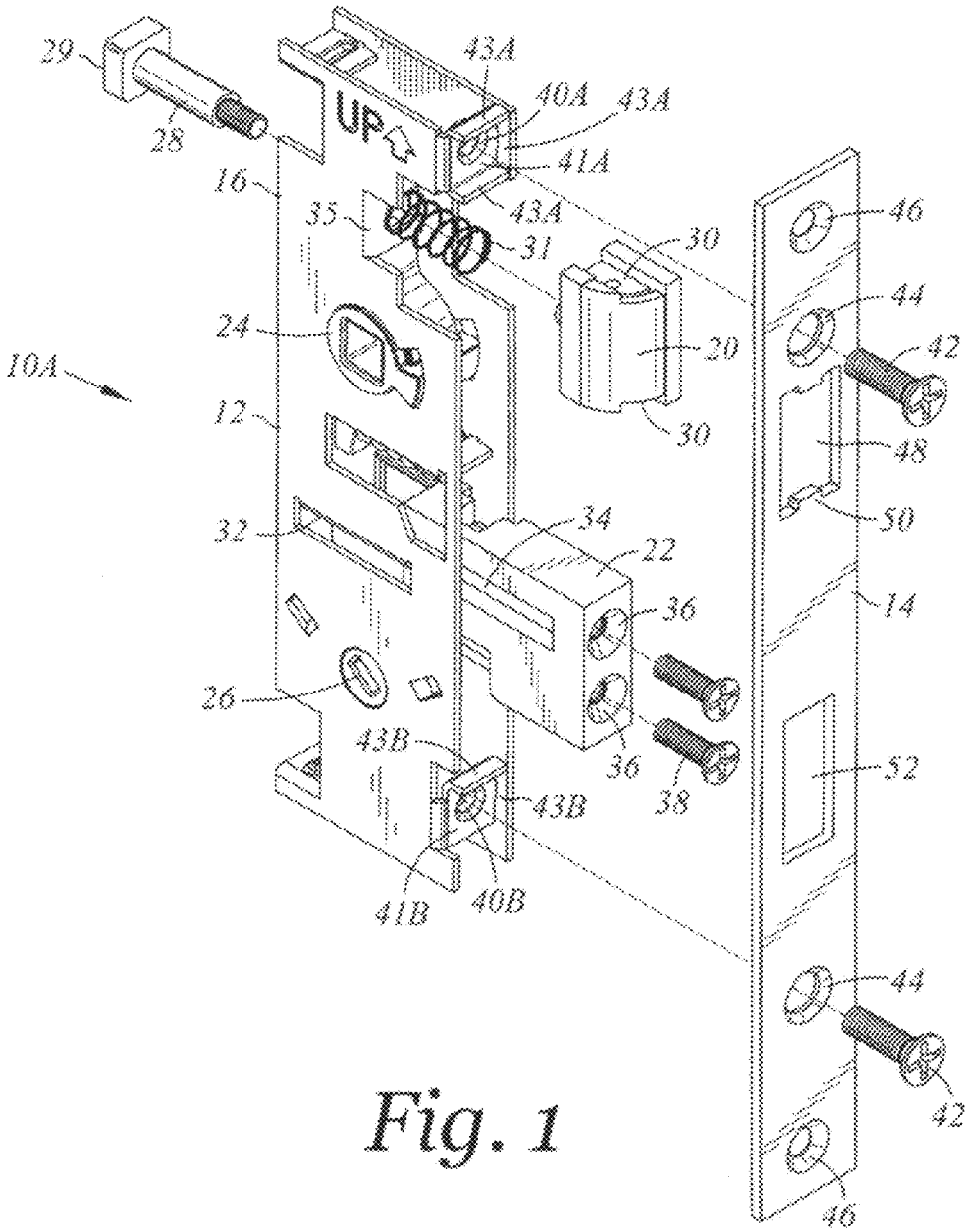
FIG. 1 is a front perspective view of an adjustable backset mortise lock of the present invention.
Figure 3:
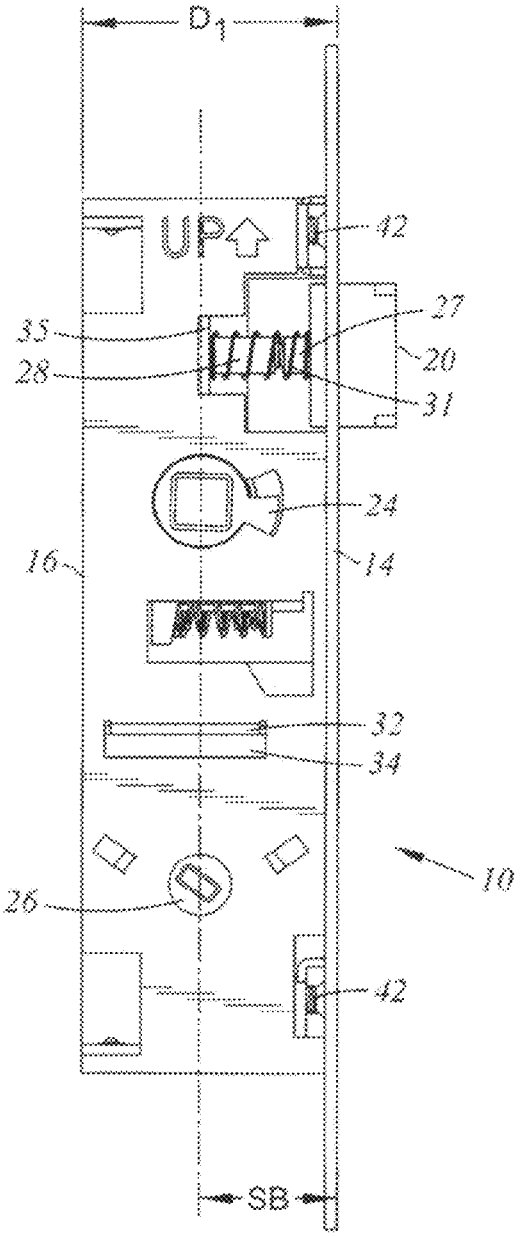
FIG. 3 is a side view of the adjustable backset mortise lock of FIG. 1.
Figure 4:
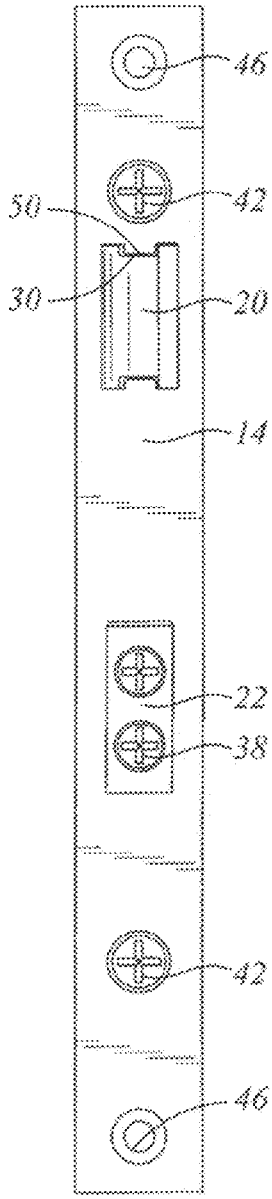
FIG. 4 is a front view of the adjustable backset mortise lock of FIG. 1.

Referring to FIGS. 1, 3 and 4, the base adjustable mortise lock 10A comprises a housing 12 with the lock operating mechanism (not shown), and a face plate 14. Mortise lock operating mechanisms can vary in design and construction. The present mortise lock can operate with virtually any mortise lock operating mechanism. The operating mechanism permits the dead bolt 22 to be extended out of the front side of the housing 12 or be retracted into the housing with a key cylinder (not shown) or a thumb turn (not shown) connected to driver cam 26. The operating mechanism also permits the latch bolt 20 to retracted into the housing with a lockable or non-lockable door knob or door latch (not shown) with driver cam 24.

Figure 5:
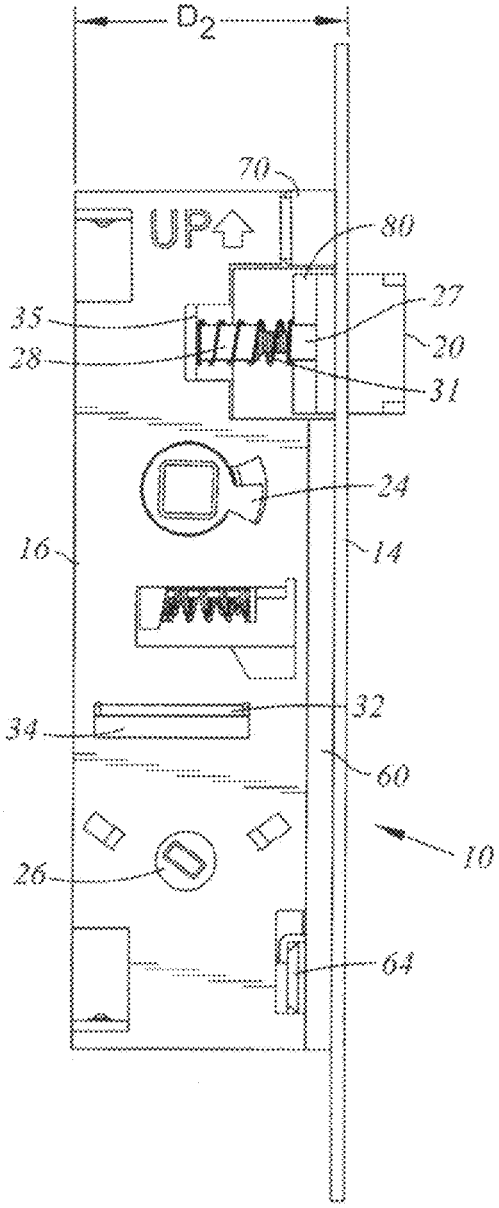
FIG. 5 is a side view of the adjustable backset mortise lock of FIG. 2.

The latch bolt 20 is supported by guide 28. The side walls of the squared back end 29 of the guide rides between the two side plates 16 of the housing 12. The latch bolt 20 has a threaded boss 27 that extends out from the back of the latch bolt that threadingly engages the threaded front end of the guide 28 (FIGS. 3 and 5). The guide 28 slidingly rides in a guide bore (not shown) in wall 35 and extends through a compression spring 31 that biases the latch bolt to extend out of the front of the housing. The spring rests on wall 35. The latch bolt 20 has guide channels 30 on its top side and bottom side that slidingly engage guide fingers 50 on the face plate 14 to minimize play of the latch bolt when it is in operation. The dead bolt 22 is supported by guide runners 32 extending inward from the side plates 16 which ride in guide channels 34 in the dead bolt. The front side of the dead bolt has two counter sunk threaded bores 36 which receive threaded fasteners 38. The threaded fasteners lie flush with the front face of the dead bolt, that is, the top of threaded fasteners are flush with the front surface of the dead bolt. The front side of the housing has an upper receiver 41A with a threaded bore 40A and a lower receiver 41B with a threaded bore 40B. The upper receiver has upper and lower parallel walls and a side wall 43A. The lower receive 43B has upper and side wall 43B.

The housing 12 is inserted into a mortise in the side edge of a door (not shown). The housing is supported in the door by the face plate 14. The face plate has two counter sunk bores 44 to receive threaded fasteners 42 which are threadingly received in threaded bores 40A and 40B in the upper and lower receivers 41A and 41B. Threaded fasteners 42 fastened the face plate 14 to housing 12. The face plate has latch bolt opening 48 for the latch bolt and a dead bolt opening 52 for the dead bolt. The top and bottom of opening 48 have fingers 50 which slidingly engage guide channels 30 in the latch bolt. The face plate is secured to the side edge of a door with threaded fasteners (not shown) that are received in counter sunk bores 46 so the fasteners are flush with the face plate, that is the top surface of the threaded fastener is flush with the surface of the face plate. The threaded fasteners 38 and 42 received in the dead bolt and the face plate have flat heads to lie flush with the surface of the dead bolt and the face plate.

Figure 2:
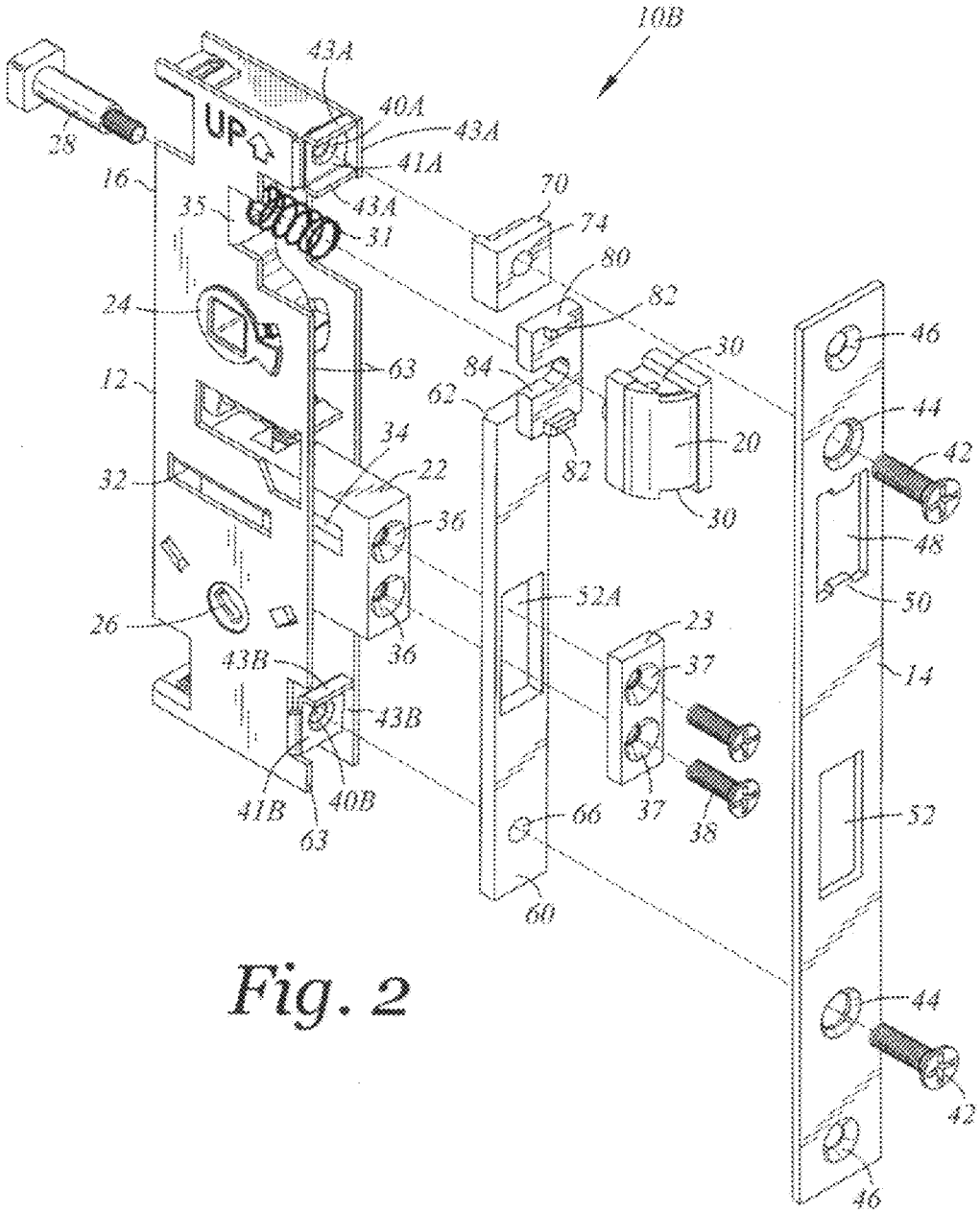
FIG. 2 is a front perspective view of another embodiment of the adjustable backset mortise lock of the present invention.
Figure 6:
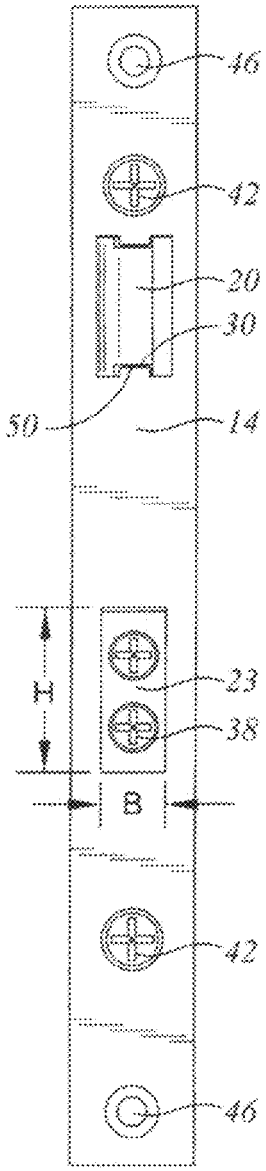
FIG. 6 is a front view of the adjustable backset mortise lock of FIG. 2.
Figure 7:
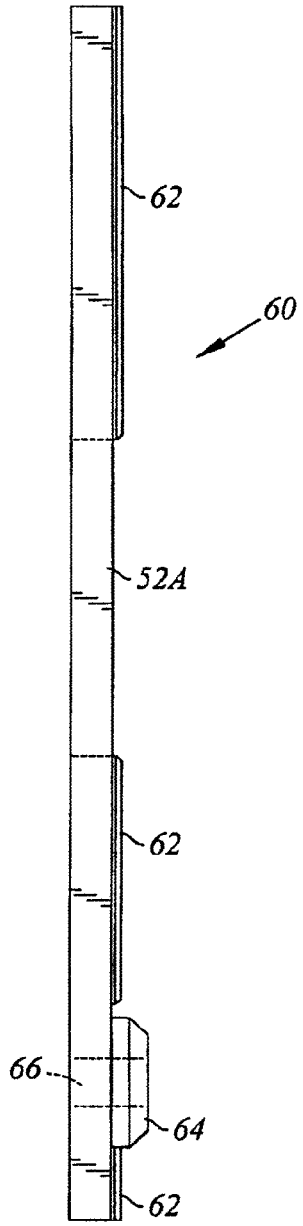
FIG. 7 is a side view of the face plate spacer of the adjustable backset mortise lock of FIG. 2.
Figure 8:
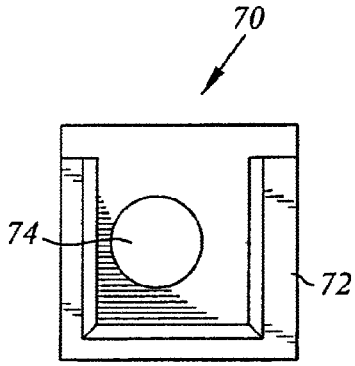
FIG. 8 is a back view of the small spacer of the adjustable backset mortise lock of FIG. 2.

The mortise lock of the present invention can be manufactured for two or more backsets easily. The mortise lock of FIGS. 1, 3 & 4 is the base mortise lock with the smallest offset and has a housing of the smallest depth $D_1$ (FIG. 3). The mortise lock of FIGS. 2, 5 & 6 is a modified base mortise lock with spacers and has a large offset and a large depth $D_2$ (FIG. 5). Thus the mortise lock of the present invention permits one to manufacture a base mortise lock and with the mere addition of spacers supply a mortise lock with a larger offset. The spacers increase the depth of the mortise lock 10B a predetermined distance, increase the offset by the predetermined distance, and increase the reach of the latch bolt and the dead bolt a predetermined distance.

Referring to FIGS. 2 & 5-8 adjusted mortise lock 10B comprises a housing 12 with the lock operating mechanism (not shown), and a face plate 14. As discussed above, mortise lock operating mechanisms can vary in design and construction. The elements that are common to both mortise locks 10A and 10B have the same number and such elements have been discussed above with respect to mortise lock 10A and will not be described again except as necessary to describe the adjusted mortise lock 10B.

The body of adjusted mortise lock 10B has greater depth $D_2$ than the depth $D_1$ of adjustable mortise lock 10B, such as by distance x. This is accomplished by spreading the distance between the housing 12 and the face plate 14 (the housing and face plate for both mortise locks are identical). This spread between the housing and face plate is accomplished by using spacers 60 and 70 as described below. This spread decreases the reach of the latch bolt and dead bolt which is accommodated by extending the distance from the back end of the guide 28 to the back end of the latch bolt and extending the length of the dead bolt. Thus when the distance between the housing and the face plate is increased by x, the distance from the back end of the guide 28 to the back end of the latch bolt is increased by distance x and the length of the dead bolt is also increased by distance x.

As shown in the figures, the latch bolt 20 has a threaded boss 27 that extends out from the back of the latch bolt that threadingly engages the threaded front end of the guide 28. The distance between the back of the guide and the back of the latch bolt is extended by screwing out the guide from the boss the desired distance x. A spacer 80 is added to the back of the back of the latch bolt to lengthen the latch bolt body so that it does not wobble in the lock during use. Spacer 80 has an open channel 84 which is received on boss 27 at the back of the latch bolt and two fingers 82 which are received in guide channels 30 of the latch bolt to minimize movement between the spacer and the latch bolt during use. The spring 31 rests on the back of the spacer 80 and the spacer insures that the biasing force on the latch bolt remains the same as in the adjustable mortise lock 10A (the same spring 31 is used). The biasing pressure also helps retain the spacer 80 on the guide 28 and against the back of the latch bolt. The length of the dead bolt 22 is increased by securing the extension 23 to the front of the dead bolt using threaded fasteners 38. The threaded fasteners have a beveled base that is received in the counter sunk bores 36 and 37 and a flat head that lies flush with front of the extension 23. As described with respect to mortise lock 10A, the front side of the dead bolt has two counter sunk threaded bores 36 which receive threaded fasteners 38. The extension has two counter sunk bores 37 co-axial with bores 36. Threaded fasteners 38 extend through bores 37 into bores 36 to secure the extension 23 to the dead bolt 22.

The distance between the housing and the face plate is increased by using small spacer 70 and face plate spacer 60. The thickness of the small spacer 70 and the face plate spacer 60 is the same as the thickness of the spacer 80 and the extension 23. The small spacer 70 has bore 74 (See FIGS. 2 & 8) to receive threaded fastener 42 which extends through the counter sunk bore 44 of the face plate, the bore 74 and into threaded bore 40A of the upper receiver 41A. The face plate spacer 60 has shoulders 62 which receive the front edges 63 of the side plates 16 of the housing 12 to prevent side to side movement of the face plate spacer. The face plate spacer has an opening 52A through which the dead bolt 22 with extension 23 can move through as the dead bolt is extended and retracted. Opening 52 in the face plate and opening 52A are co-axial and in total alignment for free movement of the dead bolt. The face plate spacer also has a boss 64 with a bore 66. The boss 64 is received by lower receiver 41B against the top wall and side wall 43B. The face plate spacer is secured in place by its shoulders 62 interacting with the housing front edges 63 as described above with the lower threaded fastener 42 passing through the face plate and the face plate spacer into threaded bore 40B of the lower receiver. In addition the face plate itself when fastened to the housing by both upper and lower threaded fasteners 42 engages the face plate spacer shoulders with the housing edges.

As described above, the mortise lock of the present invention can be easily manufactured for two or more backsets employing the same base mortise lock 10A. In addition, the lock can be supplied as a kit which permits the installer to modify the backset as required for installation. This is a boon to both manufacturers and consumers and makes available mortise locks of different backsets at favorable costs.

What is claimed is:

1. An adjustable backset mortise lock, comprising:

a housing having a front side, the housing containing a lock operating mechanism for retracting a latch bolt and extending and retracting a dead bolt and adapted to be received in a mortise in the side of a door, the housing having an upper receiver and a lower receiver on its front side, the upper receiver optionally receiving a small spacer for increasing a depth of the housing a predetermined distance, the lower receiver optionally receiving a boss of a face plate spacer for increasing the depth of the housing a predetermined distance, the latch bolt having a front end and an opposing back end and being biased to normally extend from the front of the housing, the latch bolt supported by a guide in the housing for retraction into and extension out of the housing, the guide having a threaded front end and opposing back end, the threaded front end of the guide threadingly engaging a threaded boss on the back end of the latch bolt, the distance between the front end of the latch bolt and the back end of the guide being adjustable to increase a reach of the front end of the latch bolt when the depth of the housing is increased, the dead bolt having a front side that can be extended out of or retracted into the front side of the housing, the dead bolt optionally receiving an extender to increase a reach of the dead bolt when the depth of the housing is increased, the extender secured to the front side of the dead bolt;

a latch bolt driver cam for retracting the latch bolt into the housing, and a dead bolt driver cam for extending and retracting the dead bolt into the housing, the latch bolt driver cam and dead bolt driver cam operating on the lock operating mechanism for extending and retracting the latch bolt into the housing and extending and retracting the dead bolt out of and into the housing; and a face plate having openings for the latch bolt and the dead bolt to extend through, the face plate being detachably fastened to the front of the housing and adapted to be mounted on the side of the door to support the adjustable backset mortise lock in the side of a door, the front side of the housing being configured to receive the face plate spacer to increase the depth of the housing by the predetermined distance, the back side of the face plate being received by the front side of the housing or optionally received by the small spacer, the face plate spacer, and the lower receiver when the depth of the housing is increased, the face plate including first and second guide fingers extending inward from upper and lower edges, respectively, of the latch bolt opening;

wherein the latch bolt has a first guide channel on its top surface and a second guide channel on its bottom surface, and the first guide channel slidably receives the first guide finger and the second guide channel slidably receives the second guide finger a latch bolt spacer for increasing a length of the latch bolt when the depth of the mortise lock is increased the predetermined distance.

2. The adjustable backset mortise lock according to claim 1 wherein the upper receiver has a threaded bore to receive a threaded fastener to secure the face plate to the housing.

3. The adjustable backset mortise lock according to claim 1 wherein the lower receiver has a threaded bore to receive a threaded fastener to secure the face plate to the housing.

4. The adjustable backset mortise lock according to claim 1 wherein the dead bolt has two counter sunk threaded bores receiving threaded fasteners flush with the front side of the dead bolt and the extender has a height and breath no greater than a height and breadth of the dead bolt.

5. The adjustable backset mortise lock according to claim 4 wherein the front side of the dead bolt has two threaded bores and the extender has two countersunk smooth bores co-axial with said two threaded bores in the dead bolt, the extender being secured to the dead bolt with the threaded fasteners that fit flush with the front side of the extender.

6. The adjustable backset mortise lock according to claim 1 including a biasing means, the threaded front end of the guide extending through the biasing means.

7. An adjustable backset mortise lock, comprising:

a housing having a front side, the housing containing a lock operating mechanism and being adapted to be received in a mortise in a side of a door, the housing having an upper receiver and a lower receiver on its front side, the upper receiver optionally receiving a small spacer for increasing a depth of the housing by a predetermined distance, the small spacer having a shoulder extending more than half way around the spacer, the upper receiver having a threaded bore to receive a first threaded fastener to secure a face plate to the housing, the upper receiver having a planar base surface, and upper and lower parallel walls and a rearward wall, the walls extending perpendicularly away from the base surface at a periphery thereof, the front edges of the walls of the upper receiver being received within the shoulder of the small spacer when the small spacer is received within the upper receiver, the small spacer having a bore through which the first threaded fastener extends when securing the face plate to the housing, the small spacer bore being co-axial with the threaded bore in the upper receiver, the lower receiver having a threaded bore receiving a second threaded fastener to secure the face plate to the housing, the lower receiver having an upper wall and a back wall, a boss on the face plate spacer being received within the walls of the lower receiver when the depth of the housing is increased the predetermined distance, the face plate spacer having a bore extending through the boss and the face plate spacer through which the second threaded fastener extends when securing the face plate to the housing, the bore of the face plate spacer being co-axial with the threaded bore in the lower receiver;

a latch bolt having a front end and an opposing back end and biased to normally extend from the front side of the housing, the latch bolt being supported by a guide in the housing for retraction into and extension out of the housing, the guide having a threaded front end and opposing back end, the threaded front end of the guide threadingly engaging a threaded boss on a back end of the latch bolt, a distance between the front of the latch bolt and the back end of the guide being adjustable to increase a throw of the latch bolt when the depth of the housing is increased the predetermined distance;

the latch bolt having guide channels on its top side and bottom side extending from a back side to a front side of the latch bolt, a biasing means biasing the latch bolt out of the front side of the housing, the threaded front end of the guide extending through the biasing means;

a latch bolt spacer for increasing a length of the latch bolt when the depth of the mortise lock is increased the predetermined distance;

a dead bolt having a front side, the dead bolt optionally receiving an extender having a front side to increase a length of the dead bolt when the depth of the housing is increased the predetermined distance, the extender having a height and breadth no greater than a height and breadth of the dead bolt;

the front side of the dead bolt having two threaded bores and the extender having two countersunk smooth bores co-axial with said two threaded bores in the dead bolt, the extender being secured to the dead bolt with threaded fasteners that fit flush with the front side of the extender;

a latch bolt driver cam for retracting the latch bolt into the housing, and a dead bolt driver cam for extending and retracting the dead bolt into the housing, the latch bolt driver cam and the dead bolt driver cam operating on the lock operating mechanism for extending and retracting the latch bolt into the housing and extending and retracting the dead bolt out of and into the housing; and a face plate having openings for the latch bolt and the dead bolt to extend through, the face plate including a pair of guide fingers extending inward from opposite edges of the latch bolt opening, the face plate being detachably fixed to the front side of the housing and adapted to be mounted on the side of the door to mount the adjustable backset mortise lock in the side of the door, the front side of the housing being adapted to receive the face plate spacer to increase the depth of the housing by the predetermined distance, a back side of the face plate being received by the front side of the housing or optionally received by the small spacer, and the face plate spacer, when the depth of the housing is increased by the predetermined distance;

wherein the guide channels in the latch bolt slidably receive the guide fingers extending inward from opposite edges of the latch bolt opening.

8. An adjustable backset mortise lock, comprising:

a housing having a front side, the housing containing a lock operating mechanism and being adapted to be received in a mortise in a side of a door, the housing having an upper receiver and a lower receiver on its front side, the upper receiver receiving a removable small spacer for increasing a depth of the housing a predetermined distance, the lower receiver receiving a boss of a face plate spacer for increasing the depth of the housing by the predetermined distance;

a latch bolt having a front end and an opposing back end and biased to normally extend from the front side of the housing, the latch bolt being supported by a guide in the housing for retraction into and extension out of the front side of the housing, the guide having a threaded front end and an opposing back end, the threaded front end of the guide threadingly engaging a threaded boss on the back end of the latch bolt, a distance between the back end of the latch bolt and the back end of the guide being adjustable to adjust a length of the latch bolt to accommodate increasing the depth of the housing by the predetermined distance, the latch bolt having at least one guide channel on its top side and/or bottom side extending from the back end to the front end of the latch bolt;

a dead bolt having a front side, the dead bolt receiving an extender to increase a length of the dead bolt when the depth of the housing is increased by the predetermined distance, the extender removably secured to the front side of the dead bolt;

a latch bolt driver cam for retracting the latch bolt into the housing, and a dead bolt driver cam for extending and retracting the dead bolt into the housing, the latch bolt driver cam and dead bolt driver cam operating on the lock operating mechanism for extending and retracting the latch bolt into the housing and extending and retracting the dead bolt out of and into the housing; and a face plate having openings for the latch bolt and the dead bolt to extend through, the face plate including at least one guide finger extending inward from an edge of the latch bolt opening, the face plate being detachably fixed to the front side of the housing and spaced apart therefrom by the small spacer and the face plate spacer, the face plate being adapted to be mounted on the side of the door to mount the adjustable backset mortise lock in the side of the door, the face plate spacer being removably secured on the front side of the housing to increase the depth of the housing by the predetermined distance, a back side of the face plate being received by the small spacer, and the face plate spacer, when the depth of the housing is increased by the predetermined distance;

wherein the guide channel in the latch bolt slidably receives the guide finger extending inward from the edge of the latch bolt opening a latch bolt spacer for increasing a length of the latch bolt when the depth of the mortise lock is increased the predetermined distance.

9. The adjustable backset mortise lock according to claim 8 wherein the upper receiver has a threaded bore to receive a first threaded fastener to secure the face plate to the housing.

10. The adjustable backset mortise lock according to claim 8 wherein the lower receiver has a threaded bore to receive a second threaded fastener to secure the face plate to the housing.

11. The adjustable backset mortise lock according to claim 10 wherein the lower receiver has an upper wall and a side wall, and the boss on the face plate is received within the two walls of the lower receiver when the depth of the housing is increased by the predetermined distance, the face plate spacer having a bore extending through the boss and the face plate, the second threaded fastener extending through said bore when securing the face plate to the housing, the bores of the lower receiver and the face plate spacer being co-axial.

12. The adjustable backset mortise lock according to claim 8 wherein the dead bolt has two counter sunk threaded bores receiving threaded fasteners and the extender has two bores there through co-axial with the threaded bores of the dead bolt, a height and breath of the extender being no greater than a height and breadth of the dead bolt.

13. The adjustable backset mortise lock according to claim 8 including a biasing means, the threaded front end of the guide extending through the biasing means.

14. A mortise lock having an adjustable backset, the mortise lock comprising:

a housing having a front side, the housing containing a lock operating mechanism and being adapted to be received in a mortise in a side of a door, the housing having an upper receiver and a lower receiver on its front side, the upper receiver receiving a removable small spacer for increasing the backset of the mortise lock by a predetermined distance, the lower receiver receiving a boss of a face plate spacer for increasing the backset of the mortise lock by the predetermined distance;

a latch bolt having a front end and an opposing back end and being biased to normally extend from the front side of the housing, the latch bolt being supported by a guide in the housing for retraction into and extension out of the front side of the housing, the guide having a threaded front end and opposing back end, the threaded front end of the guide threadingly engaging a threaded boss on the back end of the latch bolt, a distance between the back end of the latch bolt and the back end of the guide being adjustable to adjust a length of the latch bolt to accommodate increasing the backset of the mortise lock by the predetermined distance, the latch bolt having at least one guide channel on its top side and/or bottom side extending from the back end to the front end of the latch bolt;

a dead bolt having a front side, the dead bolt receiving an extender to increase a length of the dead bolt when the backset of the mortise lock is increased by the predetermined distance, the extender being removably secured to the front side of the dead bolt;

a latch bolt driver cam for retracting the latch bolt into the housing, and a dead bolt driver cam for extending and retracting the dead bolt into the housing, the latch bolt driver cam and the dead bolt driver cam operating on the lock operating mechanism for extending and retracting the latch bolt into the housing and extending and retracting the dead bolt out of and into the housing; and a face plate having openings for the latch bolt and the dead bolt to extend through, the face plate including at least one guide finger extending inward from an edge of the latch bolt opening, the face plate being detachably fixed to the front side of the housing and spaced apart therefrom by the small spacer and the face plate spacer, the face plate being adapted to be mounted on the side of the door to mount the adjustable backset mortise lock in the side of the door, the face plate spacer being removably secured on the front side of the housing to increase the backset of the mortise lock by the predetermined distance, the back side of the face plate being received by the small spacer, and the face plate spacer, when the depth of the housing is increased by the predetermined distance;

wherein the guide channel in the latch bolt slidably receives the guide finger extending inward from the edge of the latch bolt opening a latch bolt spacer for increasing a length of the latch bolt when the depth of the mortise lock is increased the predetermined distance.

* * * * *

UNITED STATES PATENT AND TRADEMARK OFFICE

CERTIFICATE OF CORRECTION

PATENT NO. : 8,702,131 B1
APPLICATION NO. : 12/661915
DATED : April 22, 2014
INVENTOR(S) : Michael Joseph Gianoli et al.

It is certified that error appears in the above-identified patent and that said Letters Patent is hereby corrected as shown below:

In the Specification

In column 5, line 67, after "of" insert -- the base --.

In column 5, line 67, delete "10B" and insert -- 10A --, therefor.

In the Claims

In column 7, line 62, after "finger" insert -- ; and --.

In column 10, line 24, after "opening" insert -- ; and --.

In column 12, line 18, after "opening" insert -- ; and --.

Signed and Sealed this
Seventh Day of April, 2015

Michelle K. Lee

Michelle K. Lee
*Director of the United States Patent and Trademark Office*